US007568633B2

(12) United States Patent
Sturman

(10) Patent No.: US 7,568,633 B2
(45) Date of Patent: Aug. 4, 2009

(54) DIGITAL FUEL INJECTOR, INJECTION AND HYDRAULIC VALVE ACTUATION MODULE AND ENGINE AND HIGH PRESSURE PUMP METHODS AND APPARATUS

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 259 days.

(21) Appl. No.: 11/331,457

(22) Filed: Jan. 13, 2006

(65) Prior Publication Data

US 2006/0150931 A1 Jul. 13, 2006

Related U.S. Application Data

(60) Provisional application No. 60/644,467, filed on Jan. 13, 2005.

(51) Int. Cl.
*F02M 45/10* (2006.01)
*B05B 1/30* (2006.01)
*F02M 51/00* (2006.01)

(52) U.S. Cl. ..... 239/91; 239/88; 239/585.1; 239/585.5; 239/533.1

(58) Field of Classification Search ..... 239/88–92, 239/533.1–533.15, 585.1–585.5; 123/445–456
See application file for complete search history.

(56) References Cited

U.S. PATENT DOCUMENTS 4,006,859 A 2/1977 Thoma
4,173,208 A 11/1979 Fenne et al.
4,627,571 A 12/1986 Kato et al.
4,856,713 A 8/1989 Burnett
5,419,492 A 5/1995 Gant et al.
5,421,521 A 6/1995 Gibson et al.
5,440,968 A 8/1995 Sekine
5,460,329 A 10/1995 Sturman
5,463,996 A 11/1995 Maley et al.
5,551,398 A 9/1996 Gibson et al.
5,640,987 A 6/1997 Sturman
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,738,075 A * 4/1998 Chen et al. ..... 123/446

(Continued)

*Primary Examiner*—Kevin P. Shaver
*Assistant Examiner*—James S Hogan
(74) *Attorney, Agent, or Firm*—Blakely, Sokoloff, Taylor & Zafman LLP

(57) ABSTRACT

Digital fuel injector, injection and hydraulic valve actuation module and engine and high pressure pump methods and apparatus primarily for diesel engines. The digital fuel injectors have a plurality of intensifier actuation pistons allowing a selection of up to seven intensified fuel pressures. The disclosed engine operating methods include using at least one cylinder for a compression cylinder for providing compressed intake air to at least one combustion cylinder. A pressure sensor in each combustion cylinder may be used to indicate temperature in the combustion cylinder to limit combustion temperatures to below temperatures at which substantial $NO_X$ is generated. A re-burn cycle may be used to complete the burning of hydrocarbons, providing a very low emission engine. A compression cylinder may be provided with a pump actuated by the piston in the compression cylinder. Various aspects and embellishments of the invention are disclosed.

6 Claims, 3 Drawing Sheets

U.S. PATENT DOCUMENTS

| | | | | |
|---|---|---|---|---|
| 5,752,659 | A | 5/1998 | Moncelle | |
| 5,826,562 | A | 10/1998 | Chen et al. | |
| 5,873,526 | A | 2/1999 | Cooke | |
| 5,906,351 | A | 5/1999 | Aardema et al. | |
| 5,979,803 | A | 11/1999 | Peters et al. | |
| 6,012,430 | A | 1/2000 | Cooke | |
| 6,085,991 | A | 7/2000 | Sturman | |
| 6,119,960 | A | 9/2000 | Graves | |
| 6,257,499 | B1 | 7/2001 | Sturman | |
| 6,412,706 | B1 | 7/2002 | Guerrassi et al. | |
| 6,474,304 | B1 | 11/2002 | Lei | |
| 6,575,384 | B2 | 6/2003 | Ricco | |
| 6,592,050 | B2 | 7/2003 | Boecking | |
| 6,655,355 | B2 | 12/2003 | Kropp et al. | |
| 6,684,856 | B2 | 2/2004 | Tanabe et al. | |
| 6,684,857 | B2 | 2/2004 | Boecking | |
| 6,769,635 | B2 * | 8/2004 | Stewart et al. | 239/558 |
| 6,776,138 | B2 | 8/2004 | Mahr et al. | |
| 6,830,202 | B2 * | 12/2004 | Coldren | 239/533.2 |
| 6,868,831 | B2 | 3/2005 | Lei | |
| 6,910,462 | B2 | 6/2005 | Sun et al. | |
| 6,910,463 | B2 | 6/2005 | Oshizawa et al. | |
| 6,951,204 | B2 * | 10/2005 | Shafer et al. | 123/445 |
| 7,108,200 | B2 * | 9/2006 | Sturman | 239/88 |
| 7,278,593 | B2 * | 10/2007 | Wang et al. | 239/533.2 |
| 2002/0053340 | A1 | 5/2002 | Lei | |
| 2003/0155437 | A1 | 8/2003 | Lei | |
| 2003/0178508 | A1 | 9/2003 | Coldren | |
| 2005/0092306 | A1 | 5/2005 | Shinogle et al. | |
| 2006/0032940 | A1 | 2/2006 | Boecking | |
| 2006/0157581 | A1 * | 7/2006 | Kiss et al. | 239/88 |
| 2006/0243253 | A1 | 11/2006 | Knight | |

* cited by examiner

DIGITAL FUEL INJECTOR, INJECTION AND HYDRAULIC VALVE ACTUATION MODULE AND ENGINE AND HIGH PRESSURE PUMP METHODS AND APPARATUS

CROSS-REFERENCE TO RELATED APPLICATION

This application claims the benefit of U.S. Provisional Patent Application No. 60/644,467 filed Jan. 13, 2005.

BACKGROUND OF THE INVENTION

1. Field of the Invention

The present invention relates to the field of internal combustion engines.

2. Prior Art

One of the problems encountered in diesel fuel injection is the satisfactory achievement of fuel injection throughout its operational range, and particularly at its two operational extremes, namely, a sufficiently small injection rate with good atomization at idle and low engine loads, and a sufficient injection rate at speed and under full engine load. Also it is recognized that better engine performance may be achieved if the normal injection is preceded by a small pilot injection, that is, an injection of a relatively small amount of fuel, preferably with a short delay before the normal injection, to allow combustion to begin by the time the normal injection begins. Consequently, good control of the injectors and the injection rates is required.

In an intensifier type injector, an actuation fluid, which may be, by way of example, fuel or engine oil, controllably pressurizes a relatively large piston, which in turn pushes on a relatively small piston to pressurize fuel for injection. Thus the fuel pressure for injection will be intensified relative to the pressure of the actuation fluid by the ratio of the two piston areas, which ratio may be, by way of example, in the range of 2 to 10. In such injectors, the injection flow rate could be controlled by varying the pressure in the rail supplying the actuation fluid pressure, though doing so is normally a relatively slow process. In particular, because of the compressibility of the actuation fluid, substantial reduction in rail pressure faster than it would normally decay without replenishment would require dumping significant amounts of actuation fluid to a low pressure vent, dissipating significant energy in the process. Similarly, increasing rail pressure requires forcing significant amounts of actuation fluid into the rail sufficiently faster than the actuation fluid is being used to make up for the compression of the actuation fluid in the rail as the pressure increases. Thus, varying rail pressure is something that can be considered over a number of engine revolutions, but not for injection cycle to injection cycle, and particularly not for pilot injection versus main injection.

DETAILED DESCRIPTION OF THE PREFERRED EMBODIMENTS

Figure 1:
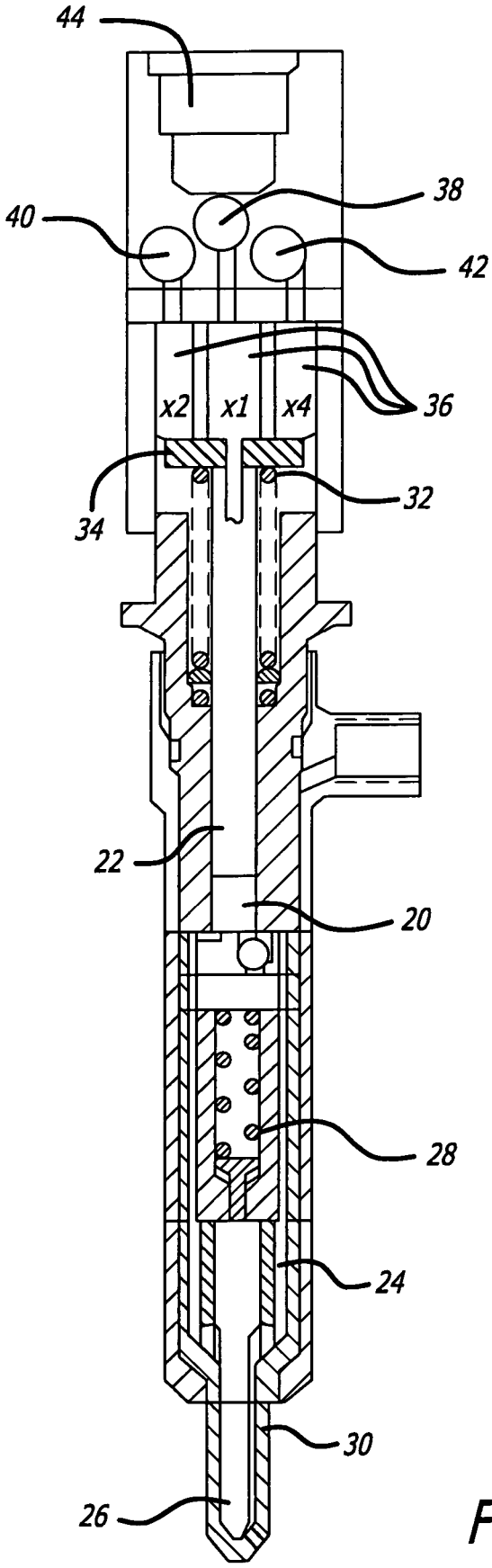
FIG. 1 is a schematic cross section of a preferred embodiment of digital injector of the present invention.

The preferred embodiment of fuel injector of the present invention is a digital fuel injector of the intensifier type for use in diesel engines. Thus a preferred embodiment of the digital injector of the present invention may be seen in FIG. 1. Fuel in region 20 is controllably pressurized by plunger 22, the pressurized fuel being coupled through porting 24 to the chamber surrounding the needle 26, forcing needle 26 upward against spring 28 for injection of the fuel through small openings or holes in the lower part of the nozzle 30. This lower part of the injector from partway up the plunger 22 down to the injector tip is shown somewhat schematically, though details of this part of fuel injectors are well known to those skilled in the art. By way of example, such details may be in accordance with well known intensified fuel injectors referred to as HEUI injectors.

Figure 2:
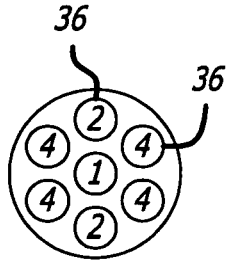
FIG. 2 is a schematic cross-section of the injector taken through the push pins 36 of FIG. 1.
Figure 4:
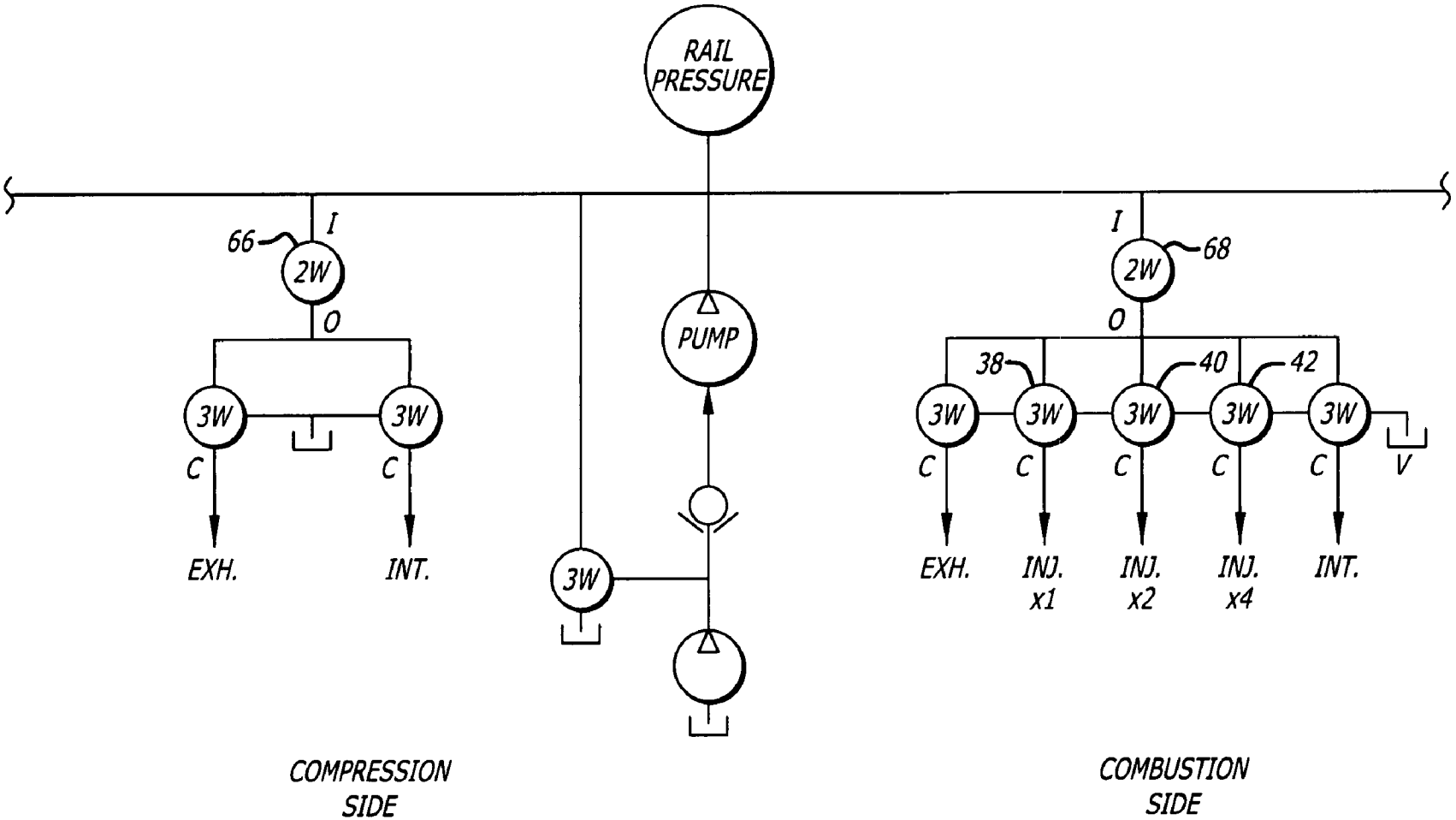
FIG. 4 is a hydraulic schematic illustrating the manifolding not shown in detail in FIG. 3.

The plunger 22 is normally encouraged upward by spring 32. In the particular embodiment shown, spring 32 operates against plate 34 fastened to the top of the plunger, though alternatively, the plunger itself could have an enlarged end, or plate 34 could be floating with a spring acting on an annular ring stopped adjacent the top end of the plunger by a spring clip in a recess adjacent the top of the plunger. In any event, above plate 34 are a number of pistons or push pins 36, specifically seven in this embodiment, as may be seen in FIG. 2, a cross-section of the injector taken through the push pins. It will be noted from FIG. 2 that the center push pin is labeled 1, thereby defining a first hydraulic piston area by the top thereof, two diametrically opposed push pins are labeled 2, thereby defining a second hydraulic piston area by the combined tons thereof, and four push pins in diametrically opposed pairs are labeled 4, thereby defining a third hydraulic piston area by the combined tops thereof. Above the push pins are three digital valves 38, 40 and 42. These valves are preferably electromagnetically actuated three-way spool valves. By way of example, they may be double actuator magnetically latching valves such as in U.S. Pat. No. 5,640,987, they may be non-magnetically latching valves, they may be single actuator spring return valves, or any of various other spool or other types of valve configurations. In this embodiment, spool valve 38 either couples the actuation fluid in region 44, the supply port, whether fuel or engine oil, to the region above the center push pin, or vents the region above the center push pin to a low pressure drain. Spool valve 40 either couples the actuation fluid in region 44 to two diametrically opposed push pins 36, the two push pins labeled with the number 2 in FIG. 2, or couples the region above these push pins to the low pressure drain. Spool valve 42 either couples the actuation fluid in region 44 to the region above four of the push pins, the push pins labeled 4 in FIG. 2, or couples the region above these push pins to the low pressure vent (V) (FIG. 4). Thus, any number of push pins may be actuated at any one time, as desired, through appropriate control of the three-way valves 38, 40 and 42 as follows:

| Spool valve Actuated | Number of Push pins activated |
|---|---|
| 38 | 1 |
| 40 | 2 |

-continued

| Spool valve Actuated | Number of Push pins activated |
|---|---|
| 38, 40 | 3 |
| 42 | 4 |
| 38, 42 | 5 |
| 40, 42 | 6 |
| 38, 40, 42 | 7 |

Of course, in the case of a skip cycle, none of the valves 38, 40 and 42 are actuated.

In the preferred embodiment, the actuation fluid is provided at a rail pressure of approximately 600 bar, and the push pins 36 have approximately ¾ the area of plunger 22. Accordingly, the intensification achieved when only a single push pin is actuated is actually less than 1, namely 0.75 or creating an injection pressure of approximately 420 bar. Actuation of all seven push pins, on the other hand, will provide an injection pressure of 3150 bar. Effectively, this system provides a binary progression in push pin area being activated, giving a wide selection of injection pressures to accommodate a wide variety of engine operating conditions. By way of example, one or two push pins might be used for the pilot injection, with the same or a larger number being used for the main injection, depending on engine operating conditions. Thus, while the injection quantity may be varied also by varying the time period of actuation of one or more of valves 38 through 42, the injection pressure itself may also be varied over a wide range by the selection of the valve or valves for actuation. In that regard, it will be noted from the above that there is no linkage between the injection pressure used for the short pilot injection and the injection pressure used for the longer main injection, which at full power might be the maximum injection pressure for high load, high engine rpm, and perhaps a somewhat lower injection pressure for a longer time for maximum power at lower engine speeds.

Figure 3:
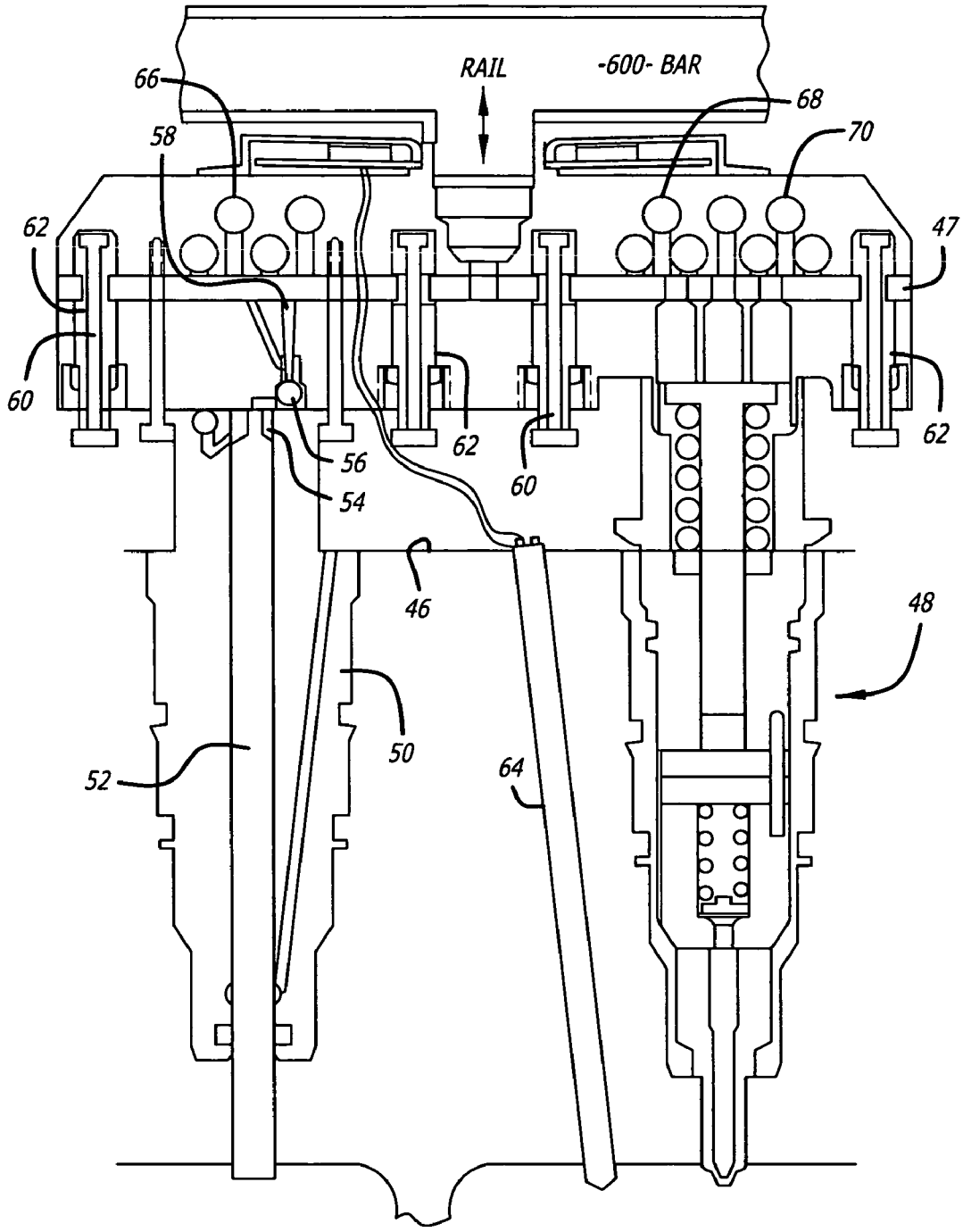
FIG. 3 is a schematic cross section of an engine module of an embodiment of the present invention.

Now referring to FIG. 3, the engine module of an embodiment of the present invention may be seen. In this Figure, the porting and manifold 47 is shown only schematically and not in detail, because of its three dimensional character, though the fluid connections will be subsequently shown diagrammatically. This module, in addition to providing fuel injection and control therefore, as well as intake and exhaust valve hydraulic actuation and control thereof, further includes a high pressure pump which receives relatively low pressure actuation fluid from a conventional pump and raises the pressure thereof to the rail pressure, in this example approximately 600 bar. The module spans two cylinders of a multi-cylinder engine, a first cylinder being used as a actuating fluid pumping and compression cylinder and a second cylinder being used as a combustion cylinder.

The operating cycle for the engine may be outlined as follows. The first cylinder is used as a compressor to boost the inlet air pressure for the second cylinder. In an experimental engine the intake valves, and for exhaust gas re-circulation (EGR) the exhaust valves, of the first cylinder will be used for air intake during its normal intake stroke (though valve timing may differ between this cylinder and the combustion cylinder). The compressed air, being compressed and thus requiring much less flow area, will or can be outlet through the glow plug opening or the injector opening in the head for that cylinder of the engine, using a simple check or one-way valve to prevent reverse flow. The compressed air may be passed through a cooler and stored in a tank for inlet to the combustion cylinder. In another embodiment, a single compressed air storage tank is pressurized using one half of the cylinders of a multi-cylinder engine, with the other half of the cylinders of the engine being the combustion cylinders using the compressed air as the intake air. Using one half of the cylinders of a multi-cylinder engine as compression cylinders and the other half of the cylinders of the engine as combustion cylinders is not a limitation of the invention, though is convenient as typically providing good engine balance and useful compression. The compressed air in the tank may or may not be intentionally cooled before entering a combustion cylinder. Obviously, one may fabricate a special head to provide the porting desired, particularly for the air pumping/compressing cylinders. The amount of pumping/compressing can be varied if desired by varying the timing of the intake valves of the respective cylinders.

In one mode of operation, the combustion cylinder (cylinders) is (are) operated as a two cycle engine, the intake and exhaust valves being open simultaneously for a short period at the end of the power stroke to clear the cylinder of much of the exhaust gas before it is (they are) closed to allow pressurization of the cylinder before the intake valves close. As a two stoke cylinder, at least twice the power of a four stroke cylinder is achieved, perhaps more because of the increased intake pressure for the combustion cylinder, making up for the loss of power from the compression cylinder. Four, six and eight stroke operation is also possible for lighter engine loads as desired.

For the actuation fluid pump, a conventional pump provides actuation fluid, in the preferred embodiment fuel, at a relatively low pressure, referred to herein as the source pressure. In an opening in the engine head, generally indicated by the numeral 46, similar to the opening provided for the digital injector of FIGS. 1 and 2 generally indicated by the numeral 48, a pump body 50 having a plunger 52 therein is provided. The plunger 52 rides on the top of an engine piston, and consequently, is always going up and down with the engine piston. On the downward movement of the engine piston, ball 56 (FIG. 3) moves off its seat, and region 54 at the top of the plunger is backfilled with the actuating fluid that is provided at the relatively low pressure by the conventional pump located elsewhere. In that regard, preferably the source pressure provided is adequate to cause the plunger to follow the piston, and of course the plunger could be lightened for this purpose by using a hollow tube-like plunger with end caps. Alternatively or in addition, a spring could be used to bias the plunger downward. On the upward stroke, one of two things happens. For the upward pumping stroke, the ball 56 is forced back onto its seat by the actuation fluid, and the remaining actuation fluid is forced into the rail. If the rail does not need more actuation fluid, then pressure is applied to the top of pin 58 during the downward stroke of the piston and maintained during the upward stroke, which holds the ball off its seat, allowing the actuation fluid being pumped to return to its source. Release of the pressure on the pin during the upward movement of the plunger would provide a partial pumping stoke. Of course the plunger is sized to provide the quantity of actuation fluid at the desired pressure, 600 bar in the example, to operate the hydraulically actuated engine valves and the intensifier type injector under the maximum demand, such as maximum power (maximum injection pressure and quantity) and maximum valve lift. Under other operating conditions, excess pumping capability will be present, so allowing the actuation fluid to pump back and forth at source pressure requires much less power than dumping high pressure actuation fluid through a pressure regulator.

In the particular engine for which the module is intended to be used on, each cylinder has two intake and two exhaust valves. In each case, the respective pair of valves has a bridge between them, so that pushing the bridge down will open both valves. These bridges are shown in FIG. 3 as bridges 58. Above each bridge is a hydraulic piston assembly having a first piston 60 of relatively small piston diameter and capable of a substantial stroke, with the small piston operating within a larger piston 62 of limited stroke. This allows both pistons to be effective for initiating valve opening against a substantial backpressure, yet conserves actuation fluid energy by reducing the flow of high pressure actuation fluid for then opening the valves further. The small pistons are configured at their upper end to act as a sort of dashpot during final valve closure to limit the landing velocity of the valves.

Other aspects of this embodiment visible in FIG. 3 are three two-way spool valves, each labeled 2W, and eight three-way spool valves, all preferably electromagnetically operated under processor control. Two of the three-way spool valves are labeled INT, and control the engine intake valves in the compression and combustion cylinders. Two of the three-way spool valves are labeled EX, and control the engine exhaust valves in the compression and combustion cylinders. The three of the three-way spool valves that are labeled INJ correspond to valves 38, 40 and 42 of FIG. 1, and control the push pins 36 in the injector. Also shown in FIG. 3 is a pressure sensor 64 configured to sense pressure in the combustion cylinder.

The function of the three two-way valves shown in FIG. 3 is best illustrated with respect to the hydraulic schematic of FIG. 4, which schematically illustrates the manifolding not shown in detail in FIG. 3. As may be seen therein, the two-way valves couple the rail to pluralities of the three-way valves. The three-way valve labeled P is the valve P in FIG. 3 that controls pin 58, the function of which has been previously described. The three-way valves labeled INJx1, INJx2 and INJx4 are the three three-way spool valves 38, 40 and 42, respectively, of the digital injector as shown in FIG. 1. The three-way valves having an outlet labeled EX correspond to the exhaust valve control spool valves as labeled EX in FIG. 3 for the exhaust valves of each cylinder. Similarly, the two three-way valves having their outlets labeled INT correspond to the two three-way valves in FIG. 3 labeled INT for controlling the intake valves of the respective cylinder. All three-way valves either connect the hydraulic piston areas to rail pressure through a respective control port (C) or to a low pressure vent (V).

The two-way valves perform multiple functions. One function is to reduce leakage from the high pressure rail. In particular, a three-way electromagnetically actuated spool valve generally has a relatively short land overlap for either closed port when the other port is open. This can cause significant leakage at the pressures of operation of preferred embodiments. A two-way valve, on the other hand, given the same stroke, will have an increased land overlap when closed, thus reducing leakage. Consequently, one function of the two-way valves 66, 68 and 70 is to be closable to reduce high pressure leakage from the rail when the three-way valves supplied through the two-way valves are closed anyway. Thus in periods where none of the three-way valves supplied through a respective two-way valve are open to obtain actuation fluid from the rail, the two-way valves may be closed, being opened to allow fluid flow from the inlet port (I) to the outlet port (O) shortly before the respective three-way valve opens to the rail.

Another function of the two-way valves is to limit engine valve opening or lift. For instance, without the two-way valves, when a three-way valve controlling the engine intake or engine exhaust valves couples the actuation pistons to rail pressure, the valves will open to their full lift, as there is no "off" condition for the three-way valves. However, if after such coupling but before full lift is reached, the respective two-way valve is closed, the engine valves will be retained at that lift. Accordingly, the two-way valves also provide a way of controlling lift, allowing the use of a lower lift at lower engine rpm and load to conserve energy in the valve actuation system, and similarly, to control intake valve lift in the combustion cylinder when using EGR.

The pressure sensor 64 provides another capability. The pressure sensor provides an alternate way of measuring temperature in the combustion cylinder. In particular, nitrous oxides, a highly undesirable pollutant, are only formed at temperatures above approximately 2500 degrees K. Consequently, by measuring combustion cylinder pressure and converting the same to temperature, typically by empirical as well as measured data, such as combustion cylinder intake air temperature, one can control the injection rate in the preferred embodiment at least in part through control of intensified pressure through the control of the digital injector, and/or electrically control injection rate by injection in controlled multiple injections, and/or duration of injection. Thus the engine may be operated in a very low $NO_X$ emission mode. While these controls may be on an overall engine basis (one pressure sensor per engine), sensing pressure in each combustion cylinder allows controlling the pressure profile and thus the temperature in each combustion cylinder, providing a capability of compensating for differences in injectors and other unique characteristics of each cylinder, thereby further reducing $NO_X$ emissions, improving efficiency and reducing vibration.

In the embodiment shown on FIG. 3, the pressure sensor is separate from the injector. However it should be noted that the pressure sensor may be incorporated as part of the injector, negating the need for separate access to the combustion chamber for the pressure sensor, and better integrating the combination. For this purpose, an opening may be provided between the lower end of the injector housing the needle and the copper sealing washer commonly used to seal between the injector and the engine head to communicate combustion cylinder pressures to a passage in the injector body leading to a spring loaded elongate piston in the passage. The opening between the lower end of the injector housing the needle and the copper sealing washer may be a notch in the inner diameter of the sealing washer, but is more conveniently provided as a slot in the outer surface of the lower end of the injector housing the needle for assuring alignment with the passage in the injector body leading to the spring loaded elongate piston in the passage. The pressure is sensed by sensing the position of the spring loaded elongate piston, preferably from the top of the injector, such as by a Hall effect sensor. The spring and piston may be relatively sized to provide the desired deflection versus pressure in the combustion cylinder.

In addition, or as another mode of engine operation, particularly for lighter load operation of the engine, one can control the intake and exhaust valves and the injector for the combustion cylinder to follow the initial power stroke by a recompression and subsequent power stroke of the same combustion chamber charge, a re-burn so to speak. This has the effect of fully burning any carbon and unburned hydrocarbons that would have been exhausted from the first power stroke by a conventional engine, substantially eliminating the other major sources of pollution. The net result is a very clean engine operation. In that regard, the temperature achieved on the second compression stroke should be controlled to assure that re-ignition is achieved, but preferably achieved around or just before (approximately at) the top dead center position of the piston to better recover the resulting combustion energy during the subsequent power stroke. For this purpose, the intake valves in the combustion cylinder may be momentarily opened at the end of the power stroke for the first combustion cycle to partially vent the combustion chamber to the tank holding the compressed air from the compression cylinder for control of the temperature reached on the subsequent burn cycle. In that regard, to assist in this control, the pressure sensor provides a good indication of when this second burn commences by sensing a pressure increase above that of compression alone, thereby allowing cycle to cycle adjustments to assure that the second burn occurs and occurs in a timely manner. Lookup tables or other means may also provide a look ahead estimate of the effect of a sudden change in operating conditions, such as the power setting for the engine.

Other modes of operation are also possible, given the flexibility provided. By way of example, and engine may run in a skip-cycle mode wherein one or more normal combustion cycles are skipped. Typically in such skip-cycles, both the engine intake and exhaust valves are left closed for the full cycle. Thus a four stroke operation of the engine may be the conventional intake, compression, power and exhaust strokes or a conventional two stroke operation followed by another compression and power stoke for a re-burn cycle. Similarly a six stroke operation of the engine may be the conventional intake, compression, power and exhaust strokes followed by another compression and power stoke for a re-burn cycle, or a conventional two stroke operation followed by another compression and power stoke for a re-burn cycle followed by a skip cycle (leaving all engine valves of the combustion cylinder closed for an additional compression and "power" stroke). Eight stoke operation may similarly be combinations of the forgoing for the eight strokes. Note that in some cases, particularly at light loads and idle, inclusion of skip cycles may be more efficient overall than always using power cycles of lower power because of such things as better injector performance, etc., though light loads and idle provide an ideal condition for use of re-burn cycles as described. Note that control of valve and injector operation allows intermixing of operational modes of the engine, such as may be desired for different operating conditions.

There has been described here various aspects of the present invention, many of which can be practiced alone or in various subcombinations. By way of example, digital injectors in accordance with the principles of the present invention may be used in otherwise conventional diesel engines. Modules may be used in accordance with the principles of the present invention with conventional injectors, intensified or not, with the pressure sensor, or without the pressure sensor and the engine operation modes it facilitates. Similarly, a pressure sensor per cylinder, together with a controllable injector in an otherwise conventional engine will allow control of the injectors for better cylinder to cylinder pressure and temperature profile balance as well as re-burning for reduction in emissions. Also, while hydraulic engine valve operation is specifically disclosed as preferred, other engine valve actuation methods may be used with the module, such as, by way of example, electromagnetic and piezoelectric actuation, though flexible control of at least engine valve and injection timing is needed to achieve the clean engine performance described.

In addition, for purposes of specificity of exemplary embodiments, aspects of the present invention have been described with respect to a module configured to be used on a conventional or preexisting engine block and head as a bolt-on conversion. However various changes may be made in engines designed specifically for practicing the present invention. Even as a bolt-on conversion, various changes may be made as desired, such a reconfiguring the module as desired, and/or splitting the module into two parts, one for the compression cylinder and one for the combustion cylinder. Splitting the module in two parts would allow more freedom in selection of the cylinders for compression and for combustion, though selection normally would be dictated by a smooth firing order and in the best balanced sequence. Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. An intensifier type fuel injector comprising:

a fuel injector assembly having an intensifier plunger operative to pressurize fuel for injection when encouraged toward a first direction;

first, second and third hydraulic piston areas, each disposed relative to the intensifier plunger to apply a force to the intensifier plunger to encourage the intensifier plunger toward the first direction when an actuating fluid under pressure is coupled to a respective hydraulic piston areas; and, three three-way valves, each being configured to couple a respective control port to a three-way valve supply port when in a first position and to a vent port when in a second position, the first three-way valve being coupled to the first hydraulic piston area, the second three-way valve being coupled to the second hydraulic piston area, and the third three-way valve being coupled to the third hydraulic piston area;

the three three-way valves being operable alone or in any combination to couple the supply port to any of the first hydraulic piston area, the second hydraulic piston area, the third hydraulic piston area, the first and second hydraulic piston areas, the first and third hydraulic piston area, the second and third hydraulic piston areas and the first, second and third hydraulic piston areas.

2. The fuel injector of claim 1 wherein the first hydraulic piston area is coaxial with the intensifier plunger and the second and third hydraulic piston areas are each symmetrically diametrically distributed around the first hydraulic piston area.

3. The fuel injector of claim 2 wherein the first hydraulic piston area is the area of the end of a first push pin, the second hydraulic piston area is the combined area of the ends of second and third push pins, and the third hydraulic piston area is the combined area of fourth, fifth, sixth and seventh push pins.

4. The fuel injector of claim 3 wherein the first, second and third hydraulic piston areas are in the ratio of 1, 2 and 4.

5. The fuel injector of claim 1 wherein the first, second and third hydraulic piston areas are in the ratio of 1, 2 and 4.

6. The fuel injector of claim 1 further comprised of a two-way valve having a supply port and an outlet port and configured to coupled the supply port to the outlet port when in a first position and to block flow between the inlet port and the outlet port when in a second position, the three-way valve supply port of each of the three three-way valves being coupled to the outlet port of the two-way valve.

* * * * *